US010234819B1

(12) United States Patent
Connors

(10) Patent No.: US 10,234,819 B1
(45) Date of Patent: Mar. 19, 2019

(54) FIELD REPLACEMENT TRANSFER BELT UNIT

(71) Applicants: Kabushiki Kaisha Toshiba, Minato-ku (JP); Toshiba TEC Kabushiki Kaisha, Shinagawa-ku (JP)

(72) Inventor: William M. Connors, Lexington, KY (US)

(73) Assignees: Kabushiki Kaisha Toshiba, Minato-ku (JP); Toshiba TEC Kabushiki Kaisha, Shinagawa-ku (JP)

( * ) Notice: Subject to any disclaimer, the term of this patent is extended or adjusted under 35 U.S.C. 154(b) by 0 days.

(21) Appl. No.: 15/903,901

(22) Filed: Feb. 23, 2018

(51) Int. Cl.

| | |
|---|---|
| ***G03G 21/16*** | (2006.01) |
| ***G03G 15/16*** | (2006.01) |
| ***B41J 11/00*** | (2006.01) |
| ***B41J 13/02*** | (2006.01) |

(52) U.S. Cl.
CPC ..... *G03G 21/168* (2013.01); *B41J 11/007* (2013.01); *B41J 13/02* (2013.01); *G03G 15/1615* (2013.01); *G03G 15/1675* (2013.01); *G03G 21/1647* (2013.01); *G03G 2221/1642* (2013.01); *G03G 2221/1654* (2013.01)

(58) Field of Classification Search
CPC ..... G03G 15/1615; G03G 2221/1642; G03G 2221/1654; G03G 21/168
See application file for complete search history.

(56) References Cited

U.S. PATENT DOCUMENTS

| | | | | |
|---|---|---|---|---|
| 8,660,463 | B2 * | 2/2014 | Takeshita | G03G 21/16 399/121 |
| 9,244,426 | B2 * | 1/2016 | Onodera | G03G 21/168 |

* cited by examiner

*Primary Examiner* — Erika J Villaluna
(74) *Attorney, Agent, or Firm* — Ulmer & Berne LLP

(57) ABSTRACT

A field replaceable transfer belt unit for toner-based printers includes a transfer belt and rollers for moving the transfer belt in a loop during a print operation, including a first roller configured to be driven by a driver shaft of a printer. The field replaceable transfer belt unit includes a rotatable handle for removing and replacing the field replaceable transfer belt unit from the printer. The rotatable handle is in communication with a drive cam that rotates to selectively engage and disengage the drive shaft with the first roller. Rotating the handle also secures the transfer belt unit to the printer.

18 Claims, 7 Drawing Sheets

FIELD REPLACEMENT TRANSFER BELT UNIT

TECHNICAL FIELD

This application relates generally to a transfer belt unit of a toner-based printer, and more particularly to a field replaceable transfer belt unit with latching structures configured for ease of removable and replacement.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

Toner-based print engines of MFPs utilize a transfer belt unit (TBU) as part of the printing function. Toner is selectively attracted onto one or more photoconductive drums of an electrostatic process unit (EPU) in accordance with an image to be printed. The TBU transfers the toner from the photoconductive drums onto the paper, after which the transferred toner is then fused by heat onto the paper and delivered to a tray for retrieval by a user. Like any other parts of a printer, TBUs can become worn from use and have limited life cycles, and therefore need to be periodically serviced or replaced.

Removing the TBU for maintenance or replacement is time consuming and can require a skilled technician to perform the function. Before removing the TBU, a technician typically must first disengage the drive shaft from the TBU. For example, the technician may be required to remove one or more panels or other parts from the printer in order to first access the drive shaft before the technician can manually urge the drive shaft away from the TBU. Once the technician places a TBU back into the MFP, the technician must reverse the steps and reengage the drive shaft with the TBU. If any steps are not performed or are performed incorrectly, for example if the drive shaft is not disengaged or engaged properly, the TBU or other parts of the printer can be damaged during subsequent print attempts. For these reasons, replacement of the TBU is generally not performed by the end user customer, but instead is performed by an experienced technician during a service call. However, service calls are an added expense and can take time to schedule. A malfunctioning TBU can result in down time for the MFP until the TBU is serviced or replaced.

BRIEF DESCRIPTION OF THE DRAWINGS

Various embodiments will become better understood with regard to the following description, appended claims and accompanying drawings wherein:

SUMMARY

Figure 1:
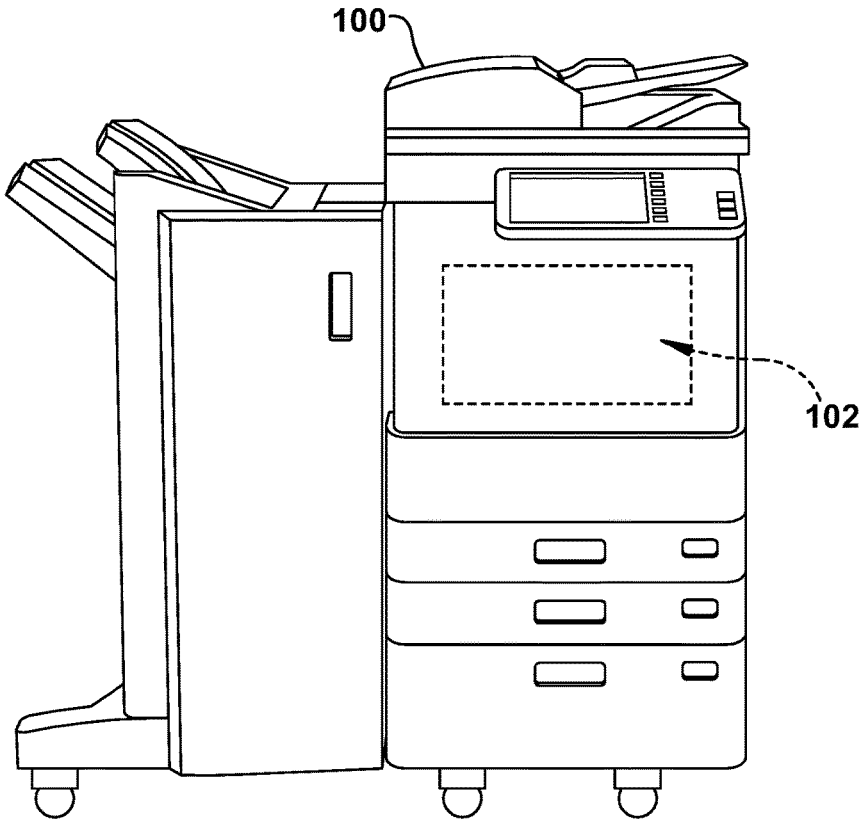
FIG. 1 is a block diagram of a multifunction peripheral.

In an example embodiment of the subject invention, a field replaceable transfer belt unit for a toner-based printer includes a transfer belt and one or more rollers that move the transfer belt in a loop during a print operation, including a first roller that is driven by a drive shaft of the toner-based printer. The field replaceable transfer belt unit includes a handle that both secures the transfer belt unit to the printer and engages the drive shaft with the first roller.

In accordance with another aspect of the subject invention the handle is a rotatable finger hold for removing and replacing the field replaceable transfer belt unit of the toner-based printer. In accordance with another aspect of the subject invention the handle is in communication with a drive cam that rotates to selectively engage and disengage the drive shaft with the first roller when the handle is rotated.

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

In toner-based electro-photographic printers, toner is picked up by a magnetic developer roller in an electrostatic process unit, or EPU, from a toner hopper. The magnetic developer roller rotates towards a photoconductive drum onto which an electric charge has been applied in accordance with a desired image to be printed, and toner from the magnetic developer roller is selectively transferred to the photoconductive drum. The toner is then transferred from the photoconductive drum to paper via a transfer belt and fused with the paper to form a printed page.

Like any other moving part of a printer, the transfer belt can become worn from use and generally has a limited useful life cycle. Transfer belts are part of a removable unit called a transfer belt unit (TBU). TBUs are typically serviced or replaced by skilled technicians due to the level of difficulty in properly removing and replacing TBU in an MFP. By way of example, to remove a TBU the technician typically must remove panels to access to parts of the printer, such as drive shafts, that need to be manually disengaged from the TBU prior to removing the TBU from the MFP. When the technician places a TBU back into the printer, the technician must reverse the steps and properly reengage the appropriate parts with the TBU. Any errors or missed steps can result in damage to the MFP. Because of the level of difficulty, servicing and replacing TBUs is generally performed during an on-site service call by an experienced technician. However, service calls take time to schedule and add to the overall costs of maintaining MFPs in the field, and customer can experience significant down times for the MFP waiting for the service call to service or replace the malfunctioning TBU.

With reference to FIG. 1, an example multifunction peripheral (MFP 100) is presented. The MFP 100 includes electrostatic-based, or toner-based, printing hardware 102 for performing printing operations as would be understood in the art.

Figure 2:
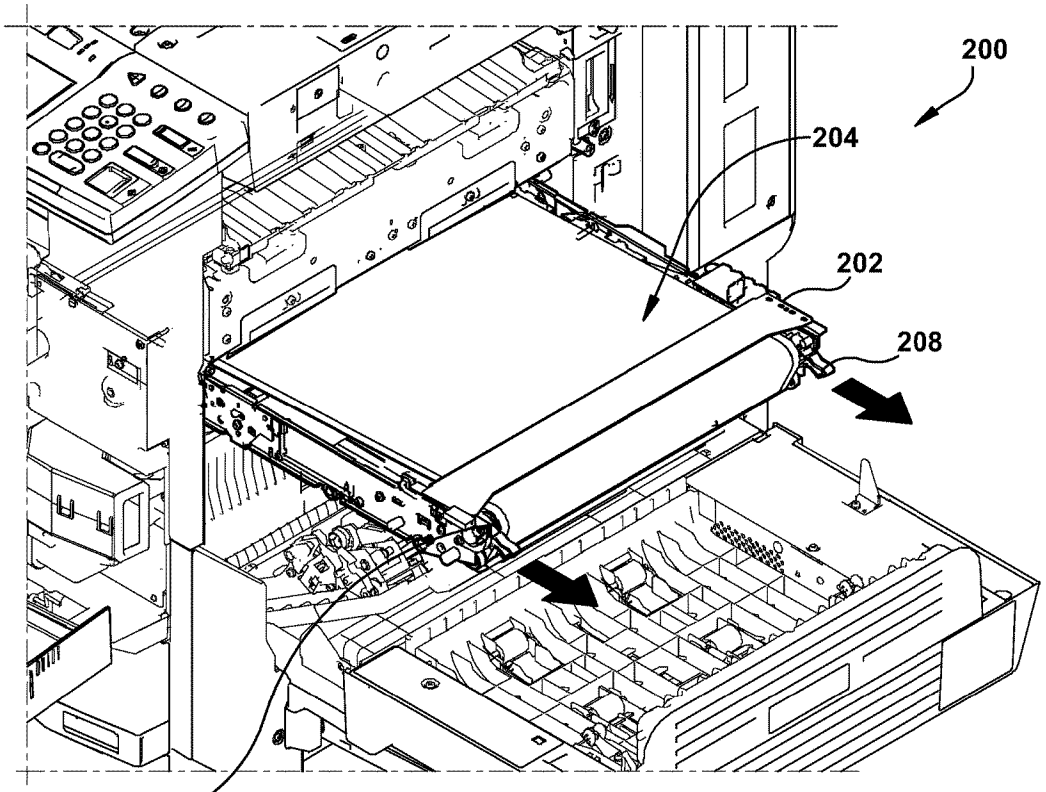
FIG. 2 is a diagram of an example transfer belt unit of a multifunction peripheral.

With reference to FIG. 2, an example MFP 200 is illustrated in an opened configuration with a transfer belt unit (TBU 202) that is in the process of being removed in the direction indicated by the arrows. The TBU 202 includes the transfer belt 204, a drive roller 206 that has been disengaged from an associated drive shaft (not shown) in the MFP 200, and holders 208 that the technician can grip to remove or insert the TBU 202 into the MFP.

Figure 3A:
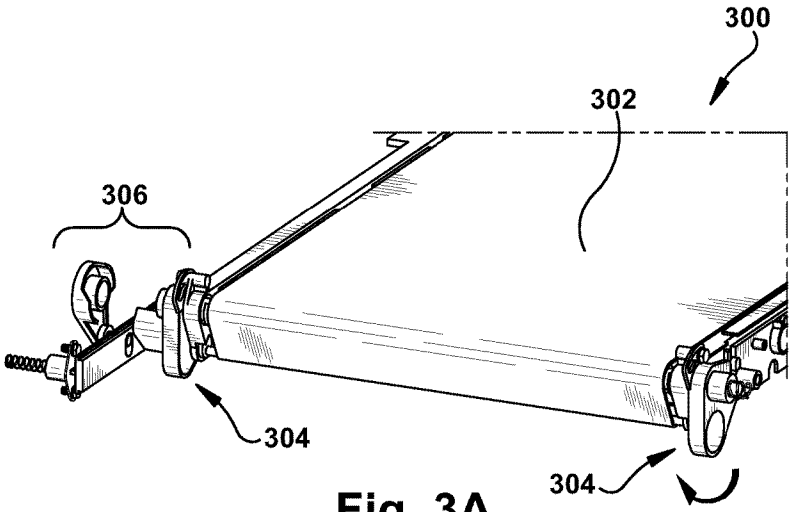
FIG. 3A is a diagram of an embodiment of a field replaceable transfer belt unit in a latched configuration.
Figure 3B:
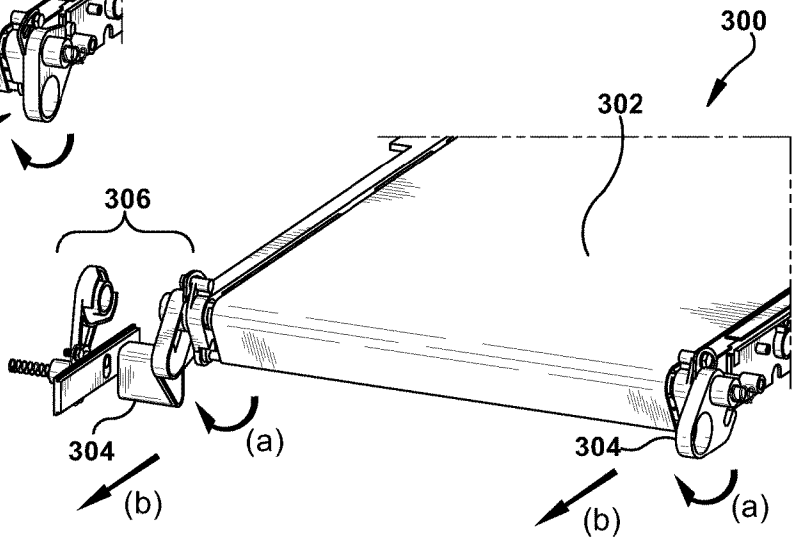
FIG. 3B is a diagram of an embodiment of a field replaceable transfer belt unit in an unlatched configuration.

With reference to FIGS. 3A and 3B, diagrams of a field replaceable transfer belt unit, TBU 300, are illustrated. TBU 300 includes a transfer belt 302, rotatable finger holds 304, and an engagement mechanism 306 which is described in further detail below. In FIG. 3A, the TBU 300 is illustrated in the latched, or engaged, position, while in FIG. 3B, the TBU 300 is illustrated in the unlatched, or disengaged, position. To transition from the latched position to the unlatched position, a user first rotates the rotatable finger holds 304 in a generally upwards rotational motion as shown by arrow (a), which causes the engagement mechanism 306 to disengage the TBU 300 from the MFP. The user then pulls the rotatable finger holds 304 in the direction shown by arrow (b) to remove the TBU 300 from the MFP. In an embodiment, the rotatable finger holds 304 comprise a finger hole sized to accept a digit of a typical user. In other embodiments, a suitable handle can be used in place of the rotatable finger holds 304 for example a loop, or any other suitable structure configured to allow the user to easily grip and maintain control of the rotatable finger holds 304 during removal and replacement of the TBU 300.

Figure 4A:
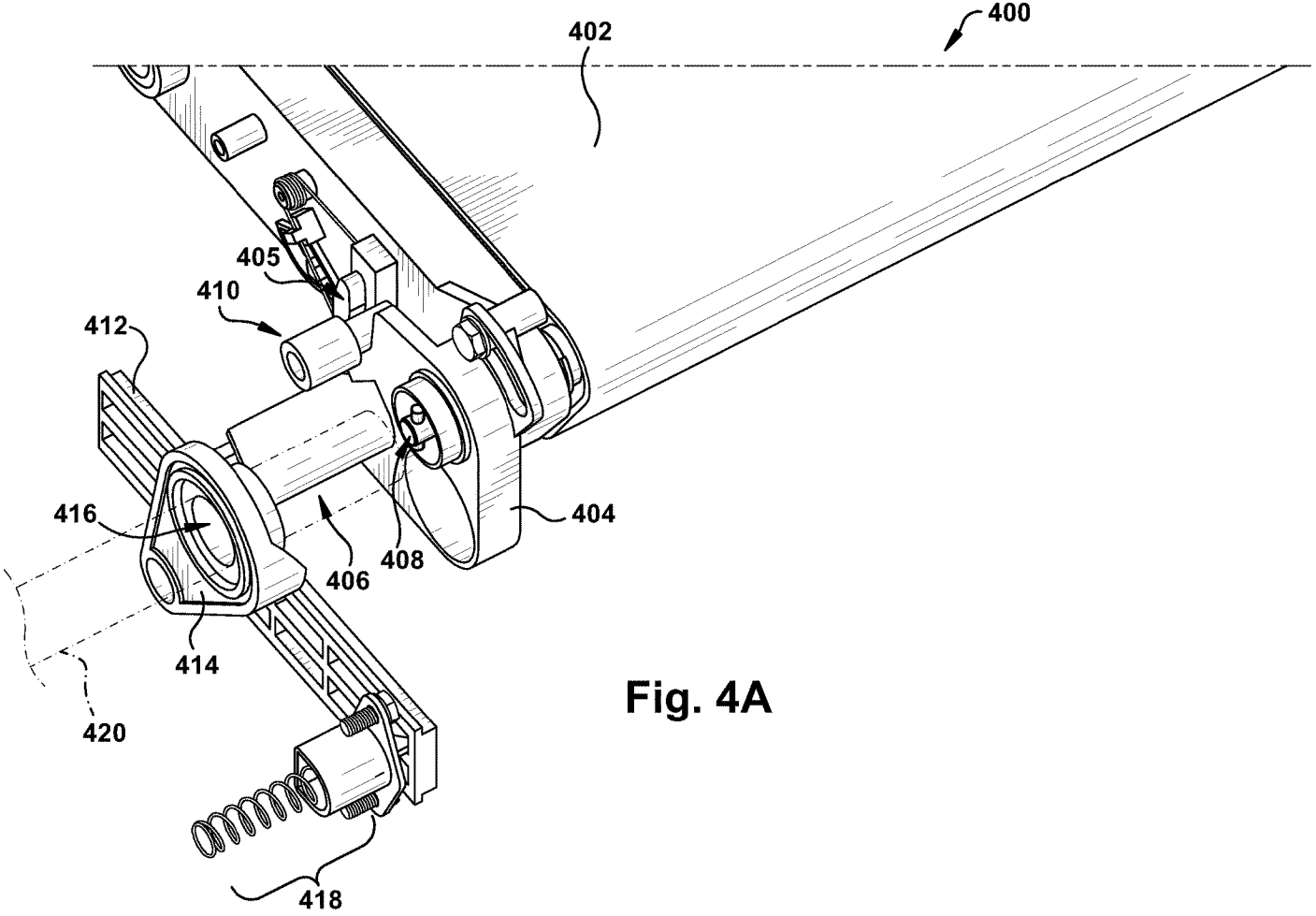
FIG. 4A is a close-up diagram of an embodiment of a latching mechanism of a field replaceable transfer belt unit in an latched configuration.
Figure 4B:
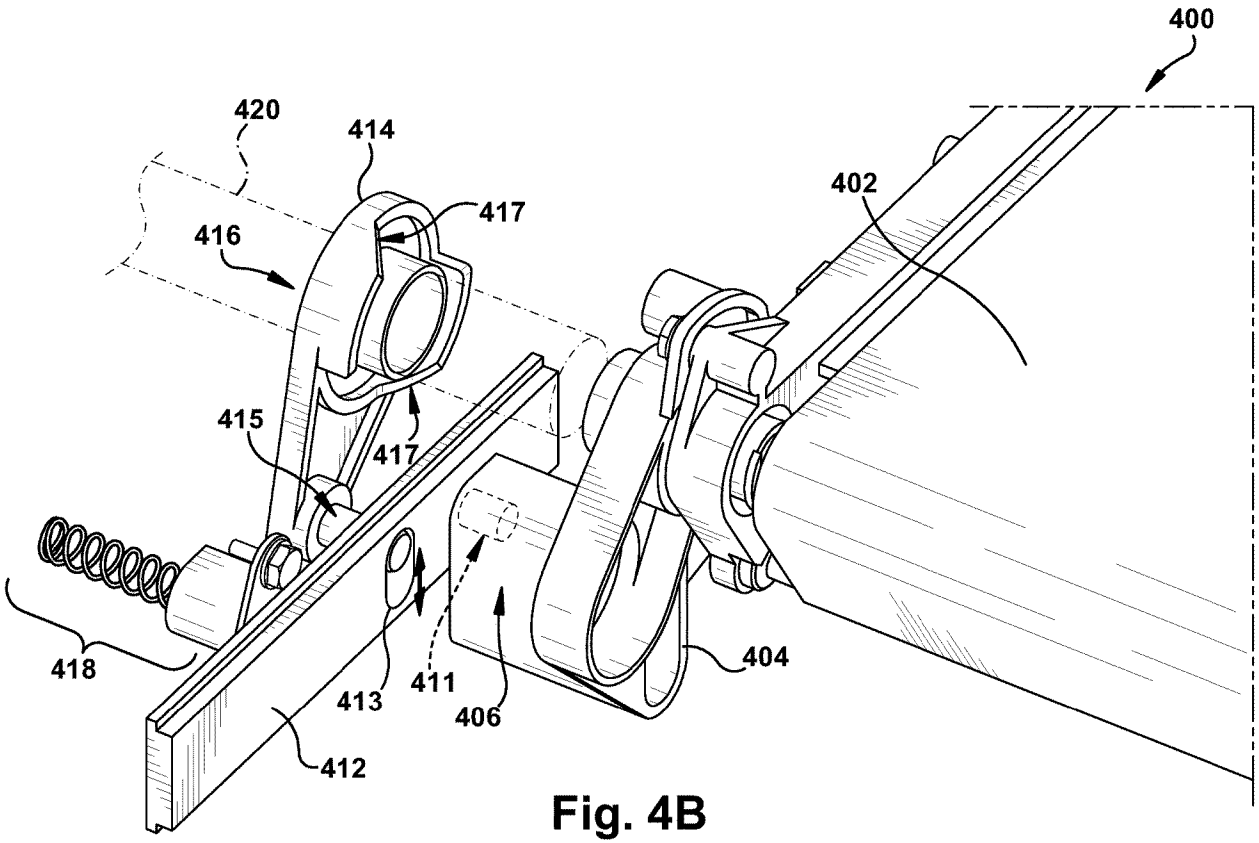
FIG. 4B is a close-up diagram of an embodiment of a latching mechanism of a field replaceable transfer belt unit in an unlatched configuration.

With reference to FIGS. 4A and 4B, close-up diagrams of an engagement mechanism of a field replaceable TBU 400 are illustrated. TBU 400 includes a transfer belt 402, a front roller 408 that is driven by a drive shaft 420 of the MFP to rotate the transfer belt 402, and a rotatable finger hold 404 having a catch 406 and latch 405. The slide 412 is configured to slide laterally, or horizontally, in an associated groove of the MFP (not shown, see FIGS. 5A and 5B). As the TBU 400 is moved in or out of the MFP, the catch 406 engages a post 411 on the slide 412 which urges the slide 412 backwards. In an embodiment, the slide 412 can be biased, for example using a spring (not shown), so as to push outward from the MFP when a TBU 400 is not inserted into the MFP.

A spring loaded detent 418 can stop the slide 412 from moving past a designed travel distance. For example, as the TBU 400 is being inserted into the MFP the spring loaded detent 418 can stop further backward travel into the MFP. The spring loaded detent 418 limits the backward movement of the TBU 400 such that the TBU stops once the TBU is positioned correctly in the MFP for engagement of the drive shaft 420 with the front roller 408, and latching the latch 405 to a post 410 of the MFP, as illustrated in the latched position of FIG. 4A.

When the TBU 400 is removed from the MFP, the catch 406 urges the post 411 forward which causes the slide 412 to translate forward. In the embodiment where the slide 412 is biased to move forward, for example using a spring as described above, instead of urging the post 411 forward, the catch 406 instead constrains the forward movement of the post 411 and the slide 412 by the biasing member. As the slide 412 moves forward, a post 415 located on an arm of the drive cam 414 is also urged forward. The post 415 is positioned inside of a vertically-oriented stadium-shaped aperture 413 in the slide 412. The aperture 413 allows the post 415 to slide up and down vertically inside of the aperture 413 while constraining movement along the horizontal axis so that the post 415 follows the movement of the slide 412. As the post 415 moves forward, the drive cam 414 is rotated around the axis of a drive shaft 420 which passes through a sleeve aperture 416 in the drive cam 414. The sleeve aperture 416 can be configured to secure the drive shaft 420 in place relative to the drive cam 414 while also allowing the drive shaft 420 to rotate freely in the sleeve aperture 416. For example a suitable c-clip, a bearing, or other suitable means can be used to secure the drive cam 414 at the appropriate position along the long axis of the drive shaft 420.

The slide 412 and drive cam 414 translate the lateral movement of the slide 412 into a rotational movement of the drive cam 414 about the axis of the drive shaft 420. In the unlatched position illustrated in FIG. 4B, the drive shaft 420 is displaced away from the front roller 408 of the TBU 400, which allows the TBU 400 to be easily removed from the MFP by the user. In the latched position illustrated in FIG. 4A, the drive shaft (not shown, see FIG. 4B) couples with the front roller 408 of TBU 400 and drives the transfer belt 402. Displacement of the drive shaft 420 is accomplished by a cam 417 in the drive cam 414 as will be described in greater detail with regard to FIGS. 5A and 5B. The direction of the displacement of the drive shaft 420 determines whether the drive shaft 420 engages with the front roller 408 or disengages from the front roller 408.

Figure 5A:
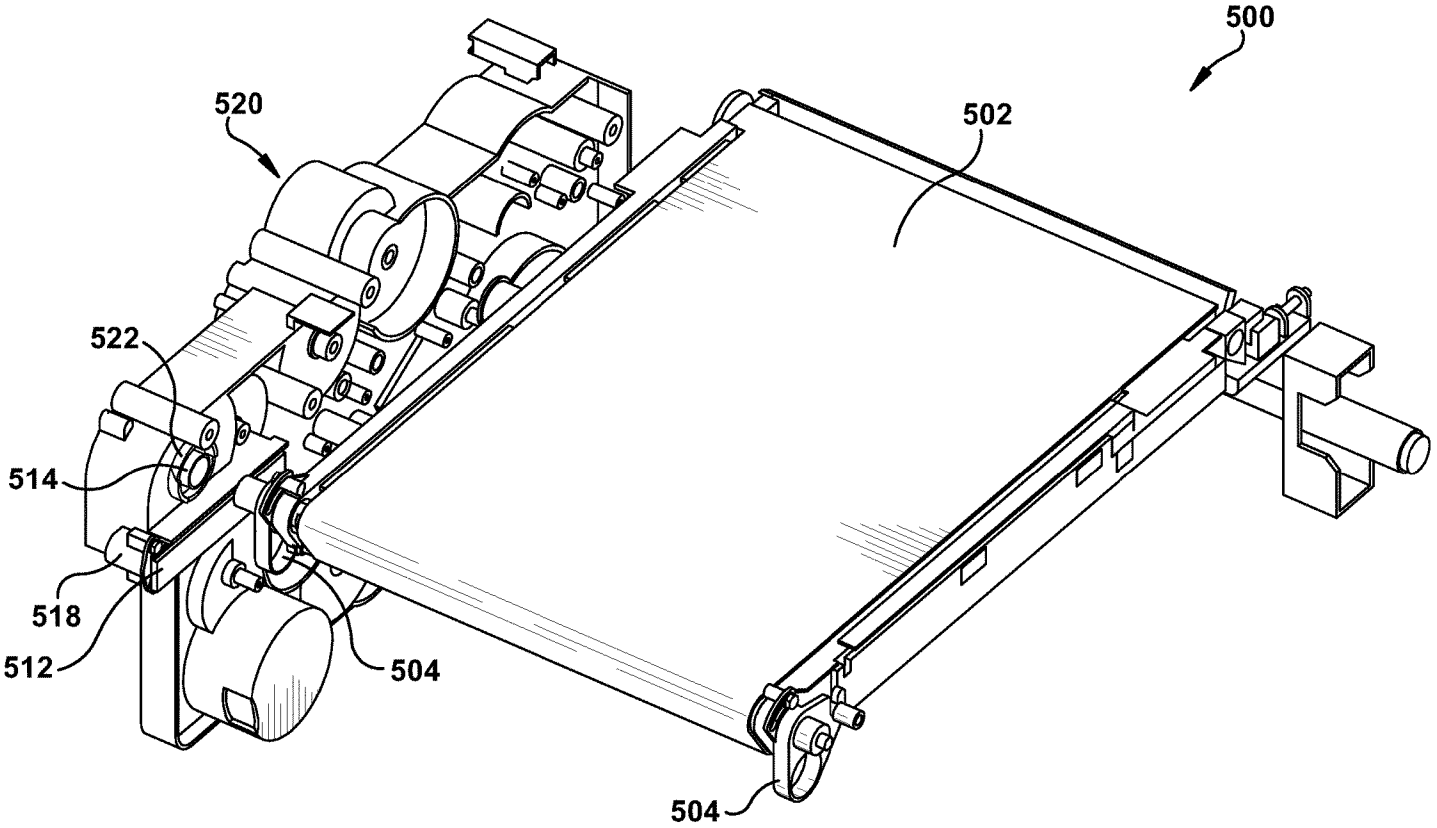
FIG. 5A is a diagram of an embodiment of a field replaceable transfer belt and multifunction peripheral.
Figure 5B:
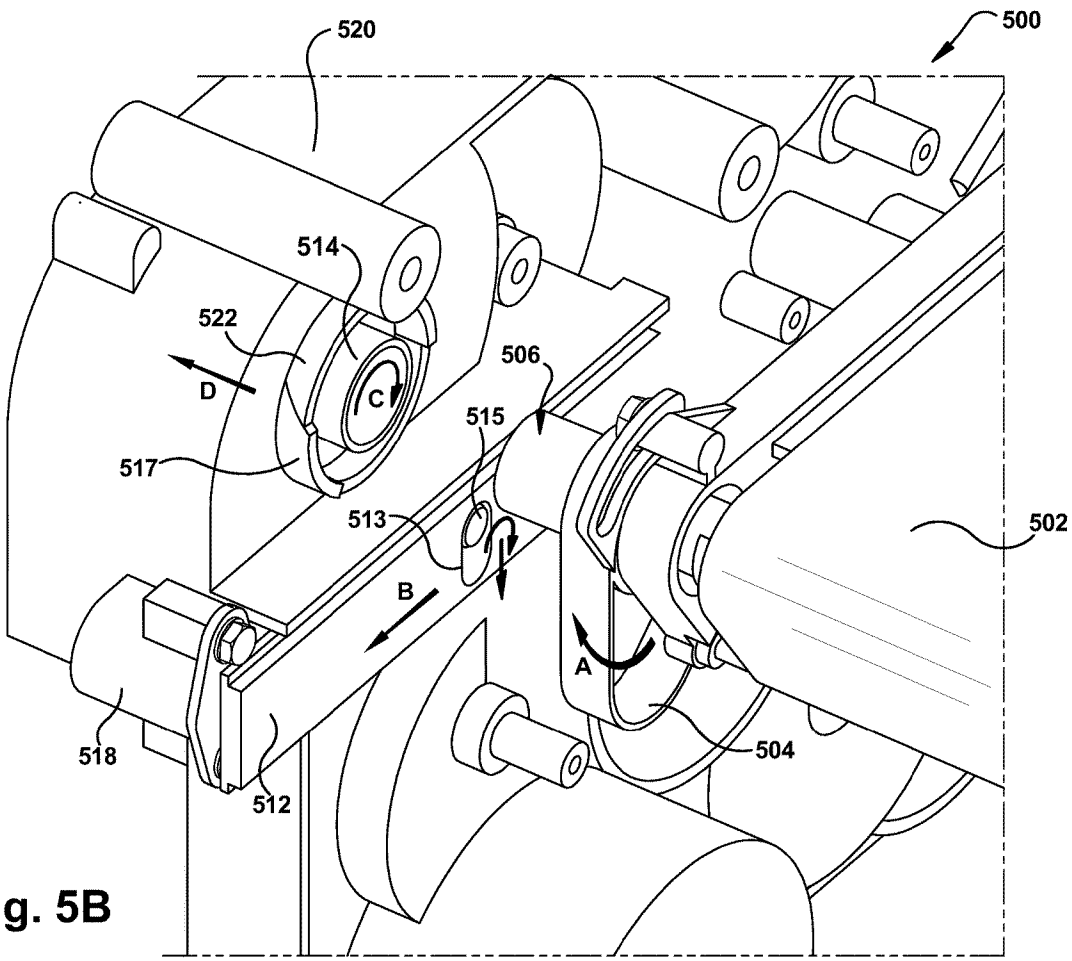
FIG. 5B is a close-up diagram of an embodiment of a field replaceable transfer belt and multifunction peripheral.

With reference to FIGS. 5A and 5B, diagrams of a field replaceable TBU 500 and MFP 520 are illustrated. The TBU 500 includes a transfer belt 502, rotatable finger holds 504 which includes 406. The MFP 520 includes a slide 512, a spring loaded detent 518, a drive cam 514 including a cam 517, and a cam strike 522. Referring also to FIG. 5B, a close-up diagram of the TBU 500 and MFP 520 is illustrated. When the rotatable finger hold 504 is rotated in the direction indicated by arrow A, a latch (not shown, see latch 405 of FIG. 4A) associated with the rotatable finger hold 504 disengages from a post (not shown, see post 410 of FIG. 4A) of the MFP 520, freeing the TBU 500 to be removed from the MFP 520. Rotating the rotatable finger hold 504 moves the catch 506 forward, causing the slide 512 to move forward in the direction indicated by arrow B. When the slide 512 moves forward, the post 515 that associated with the drive cam 514 also moves forward, causing the drive cam 514 to rotate in the direction indicated by the arrow C about the axis of the drive shaft (not shown for purposes of illustration of the cam mechanism.) The stadium-shaped aperture 413 of the slide 512 allows the post 515 to rotate relative to the slide 512 and move laterally downward in the stadium-shaped aperture 413 as the drive cam 514 rotates.

The rotation of the drive cam 514 forces one or more cams 417 in the drive cam 514 to contact the cam strikes 522 which are fixed relative to the cams 417. As the cams 417 rotate against the cam strikes 522, the drive cam 514 is forced back into the MFP 520 and away from the TBU 500 in the direction indicated by the arrow D. Because the drive shaft is linearly coupled to the drive cam 514 along the long axis of the drive shaft, the drive shaft is also moved away from the TBU 500 which disengages the drive shaft from the TBU 500, allowing the TBU 500 to be safely removed by a user from the MFP 520. In an embodiment, the drive cam 514 or the drive shaft can be biased. For example, if the drive cam 514 is not being forced into the MFP 520 by the operation of the cams 417 against the cam strike 522, a bias on the drive cam 514 or the drive shaft can push the drive shaft towards the TBU 500.

The above described mechanisms of the field replaceable TBU simplifies removal and replacement of TBUs in MFPs, making it possible for end users or customers to replace TBUs in the field without requiring a service call by a skilled technician. Rotating the rotatable finger holds of the field replaceable TBU allows a user to both disengage and unlatch a malfunctioning TBU from the MFP, as well and engage and latch a replacement TBU back into the MFP.

In light of the foregoing, it should be appreciated that the present disclosure significantly advances the art of field replaceable transfer belt units. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An apparatus, comprising:

a transfer belt configured to transfer toner from a photoconductive drum of a toner-based printer to a paper;

one or more rollers configured to move the transfer belt in a loop during a print operation and including a least a first roller configured to be driven by a drive shaft of the toner-based printer; and a handle configured to selectively secure the apparatus to the toner-based printer and selectively engage the drive shaft to the first roller, wherein the handle further includes:

a catch configured to contact a post associated with a slide, wherein when the handle is rotated into a latched orientation, the catch urges the post causing the slide to travel laterally in a first direction, which causes a drive cam to rotate and engage an associated drive shaft with the first roller, and wherein when the handle is rotated into an unlatched orientation, the catch allows the slide to travel laterally in an opposite second direction, which causes the drive cam to rotate in an opposite direction and disengage the drive shaft from the first roller.

2. The apparatus of claim 1, wherein the handle is a rotatable finger hold that includes an opening configured to accept a user digit for rotating the rotatable finger hold, removing the apparatus from the toner-based printer, and placing the apparatus in the toner-based printer.

3. The apparatus of claim 1, wherein the handle further includes:

a latch configured to secure the apparatus to a post of the toner-based printer when the handle is rotated into a latched orientation.

4. The apparatus of claim 1, wherein the drive cam further includes a post, wherein the slide further includes a stadium-shaped aperture configured to engage the post, and wherein the drive cam is coupled to the slide via the post and stadium-shaped aperture.

5. The apparatus of claim 1, further comprising:

an electrostatic process unit that includes the photoconductive drum.

6. An apparatus comprising:

a transfer belt configured to transfer toner from a photoconductive drum of a toner-based printer to a paper;

one or more rollers configured to move the transfer belt in a loop during a print operation and including a least a first roller configured to be driven by a drive shaft of the toner-based printer;

a handle configured to selectively secure the apparatus to the toner-based printer and selectively engage the drive shaft to the first roller;

a drive cam including a cam configured to rotate against a cam strike, a sleeve aperture configured to accept the drive shaft, and an arm having a post; and a slide including a stadium-shaped aperture configured to couple the slide to the drive cam via the post of the drive cam, and a post configured to contact a catch associated with the handle, wherein the drive cam and the slide are configured to translate a lateral movement of the slide into a rotational movement of the drive cam.

7. The apparatus of claim 6, wherein rotating the drive cam forces the cam to rotate against the cam strike, and wherein rotating the cam against the cam strike urges the drive cam in a direction that disengages the drive shaft from the first roller.

8. The apparatus of claim 6, further comprising:

a spring loaded detent configured to limit lateral travel of the slide.

9. The apparatus of claim 6, further comprising:

a drive shaft configured to rotate in the sleeve aperture of the drive cam, and translate laterally with the drive cam along a long axis of the drive shaft to selectively engage the first roller.

10. The apparatus of claim 6, further comprising:

a multifunction peripheral comprising the slide and the drive cam.

11. A transfer belt unit of comprising:

a transfer belt configured to transfer toner from a photoconductive drum of a toner-based printer to a paper during a print operation;

a roller in communication with the transfer belt and configured to accept a drive shaft that rotates the roller during the print operation;

a rotatable finger hold configured to selectively rotate between a latched orientation and an unlatched orientation, wherein when the rotatable finger hold is rotated into the latch orientation, the drive shaft is configured to engage the roller and a latch associated with the rotatable finger hold is configured to secure the transfer belt unit to a post associated with the toner-based printer, wherein when the rotatable finger hold is rotated into the unlatched orientation, the drive shaft is configured to disengage from the roller and the latch is rotated away from the post to unlatch the transfer belt unit from the toner-based printer; and a catch associated with the rotatable finger hold and configured to contact a slide, wherein the slide and an associated drive cam are configured to translate a lateral movement of the slide into a rotational movement of the drive cam, wherein when the rotatable finger hold is rotated into the latched orientation, the catch urges the slide in a first direction causing the drive cam to rotate and engage the drive shaft with the roller, and wherein when the rotatable finger hold is rotated into the unlatched orientation, the catch allows the slide to move in a second direction opposite the first direction causing the drive cam to rotate in an opposite direction and disengage the drive shaft from the roller.

12. The transfer belt unit of claim 11, wherein the drive cam further includes a post, wherein the slide further includes a stadium-shaped aperture configured to engage the post, and wherein the drive cam is coupled to the slide via the post and stadium-shaped aperture.

13. The transfer belt unit of claim 11, wherein the drive cam includes a cam configured to rotate against a fixed cam strike of the toner-based printer.

14. The transfer belt unit of claim 13, wherein when the drive cam rotates in a first direction the cam rotates against the cam strike which urges the drive cam in a direction that disengages the drive shaft from the roller, and wherein when the drive cam rotates in a second direction the cam rotates away from the cam strike and the drive cam moves in a direction that engages the drive shaft with the roller.

15. The transfer belt unit of claim 13, wherein the drive shaft is coupled to the drive cam via a sleeve aperture such that the drive shaft is configured to translate laterally with the drive cam along a long axis of the drive shaft while being free to rotate in the sleeve aperture of the drive cam.

16. A multifunction peripheral, comprising:

a drive cam including a sleeve aperture configured to secure a rotatable drive shaft laterally relative to the drive cam, a cam configured to rotate against a fixed cam strike to translate the drive cam laterally to selectively engage the drive shaft with a roller of a transfer belt unit, and an arm having a drive cam post; and a slide including a stadium-shaped aperture configured to couple the slide to the drive cam via the drive cam post, and a slide post configured to receive a catch associated with the transfer belt unit and move the slide laterally in response to movement of the catch, wherein the drive cam and the slide are configured to translate a lateral movement of the slide into a rotational movement of the drive cam.

17. The multifunction peripheral of claim 16, wherein the transfer belt unit includes a rotatable finger hold configured to rotate between a latched orientation and an unlatched orientation, wherein when the rotatable finger hold is rotated into the latched orientation, the catch urges the slide via the slide post in a first direction causing the drive cam to rotate and engage the drive shaft with the roller, and wherein when the rotatable finger hold is rotated into the unlatched orientation, the catch allows the slide to move in a second direction opposite the first direction causing the drive cam to rotate in an opposite direction and disengage the drive shaft from the roller.

18. The multifunction peripheral of claim 17, further comprising:

a post configured to accept a latch of the transfer belt unit for securing the transfer belt unit to the multifunction peripheral, wherein when the rotatable finger hold is rotated into the latched orientation, a latch associated with the rotatable finger hold rotates around the post to secure the transfer belt unit to the post, and wherein when the rotatable finger hold is rotated into the unlatched orientation, the latch rotates away from the post to unlatch the transfer belt unit from the post.

* * * * *